US008212851B2

(12) United States Patent
Tsuchiya et al.

(10) Patent No.: US 8,212,851 B2
(45) Date of Patent: Jul. 3, 2012

(54) PORTABLE PRINTER

(75) Inventors: Motohito Tsuchiya, Shizuoka (JP); Hiroyasu Ishii, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 233 days.

(21) Appl. No.: 12/782,096

(22) Filed: May 18, 2010

(65) Prior Publication Data

US 2011/0063399 A1 Mar. 17, 2011

(30) Foreign Application Priority Data

Sep. 17, 2009 (JP) ..... 2009-215994

(51) Int. Cl.
*B41J 2/325* (2006.01)

(52) U.S. Cl. ..... 347/222

(58) Field of Classification Search ..... 347/222, 347/197; 400/691, 693
See application file for complete search history.

(56) References Cited

U.S. PATENT DOCUMENTS 5,943,085 A * 8/1999 Higashi et al. ..... 347/222
6,092,945 A 7/2000 Takami et al.
6,505,981 B1 1/2003 Takami et al.
7,369,146 B2 * 5/2008 Maruyama ..... 347/197
7,453,483 B2 * 11/2008 Chikumoto et al. ..... 347/222
7,593,027 B2 * 9/2009 Sawai et al. ..... 347/222
2004/0080604 A1 * 4/2004 Ito ..... 347/197

FOREIGN PATENT DOCUMENTS

JP 08-300740 11/1996
JP 11-171155 6/1999

* cited by examiner

*Primary Examiner* — Kristal Feggins
(74) *Attorney, Agent, or Firm* — Turocy & Watson, LLP

(57) ABSTRACT

A portable printer includes: a housing; a platen roller configured to convey a label sheet having a base sheet; a pinch roller configured to rotate following the platen roller via the base sheet; a supporting shaft configured to support the pinch roller; a shaft holder configured to hold the supporting shaft; a removing and inserting section configured to hold the shaft holder to be removable therefrom and insertable thereinto; a pawl section provided in the shaft holder, configured to resiliently hook to the removing and inserting section; a member holding section provided in the housing; and an urging member detachably attachable to the member holding section, nipped by the member holding section and the supporting shaft, and configured to apply pressing force on the platen roller to the pinch roller.

11 Claims, 4 Drawing Sheets

PORTABLE PRINTER

CROSS-REFERENCE TO RELATED APPLICATION

This application claims the benefit of priority from Japanese Patent Application No. 2009-215994 filed on Sep. 17, 2009, the entire content of which is incorporated herein by reference.

TECHNICAL FIELD

The present invention relates to a portable printer driven by power supply from a battery.

BACKGROUND

Portable printers are widely used in various applications such as home delivery services and inventory management. Such a portable printer is disclosed in, for example, JP-A-08-300740 (hereinafter referred to as Document 1). The portable printer disclosed in Document 1 stores a label sheet attached with a base sheet wound in a roll shape. The portable printer disclosed in Document 1 applies printing based on accumulated print data to labels stuck to the base sheet while drawing out the stored label sheet. As one form of use, the portable printer disclosed in Document 1 issues printed labels from an issue port together with the base sheet. In the portable printer, a line-type thermal print head configured to come into contact with a platen roller via a guide path for the label sheet performs printing.

Another form of use of the portable printer disclosed in Document 1 is peeling and issuance of printed labels. The portable printer disclosed in Document 1 includes a label peeling plate in the guide path for the label sheet. The label peeling plate is located further on a downstream side than the thermal print head. The label peeling plate bends the guide path. In the portable printer, a pinch roller is pressed against the platen roller via the bent guide path and the base sheet of the label sheet is conveyed by the platen roller and the pinch roller. The portable printer can peel off the labels from the base sheet using the bending of the base sheet by the label peeling plate and peel off printed labels from the base sheet and issue the printed labels.

A technique for pressing the pinch roller against the platen roller via the guide path bent by the label peeling plate and peeling and issuing printed labels is a technique widely adopted in the past as described in, for example, JP-A-11-171155.

When the pinch roller is pressed against the platen roller via the guide path bent by the label peeling plate and printed labels are peeled and issued, depending on a type of a label sheet, the printed labels cannot be normally peeled and issued. As an example, such a phenomenon occurs when a label sheet having relatively strong adhesiveness of labels on a base sheet is used. In such a label sheet, it is difficult to peel off the labels from the base sheet. Therefore, when base sheet conveying force by the platen roller and the pinch roller is insufficient, slip against the base sheet occurs in the pinch roller. Then, since the platen roller performs conveyance of the label sheet in a printing unit even while the slip against the base sheet occurs in the pinch roller, a label after printing is not peeled off from the base sheet and the slack of the label sheet occurs around the label peeling plate. In such a state, the portable printer cannot peel and issue the labels any more and, in some case, causes even a sheet jam.

In this case, if the pressing pressure of the pinch roller against the platen roller is set high, the pinch roller less easily slips against the base sheet. However, for the platen roller, the pressing pressure of the pinch roller is nothing but application of resistance. Therefore, if the pressing pressure of the pinch roller against the platen roller is set too high, this causes a fall in printing speed due to a fall in conveying speed of the label sheet. In particular, in a portable printer of a battery drive type, because there is limitation on a power supply capacity, the fall in the conveying speed of the label sheet tends to conspicuously occur. Therefore, if, by change, setting of an apparatus is adjusted to an exceptional label sheet having relatively strong adhesiveness of labels on a base sheet, a disadvantage is caused in that printing speed falls when other general standard label sheets are used. This is extremely inconvenient.

SUMMARY

The present invention has been devised in view of such a point and it is an object of the present invention to prevent a fall in printing speed as long as a standard label sheet is used and prevent a peeling and issuance failure even when an exceptional label sheet having relatively strong adhesiveness of labels on a base sheet is used.

According to an aspect of the present invention, there is provided a portable printer including: a housing; a platen roller rotatably provided in the housing and configured to rotate to convey a label sheet having a base sheet and labels stuck to the base sheet; a thermal print head opposed to the platen roller and configured to apply printing to the labels of the label sheet conveyed by the platen roller; a pinch roller opposed to the platen roller on a downstream side of the thermal print head in a sheet conveying direction and configured to nip the base sheet in cooperation with the platen roller and rotate following the platen roller via the base sheet to convey the base sheet; a supporting shaft configured to support the pinch roller to be capable of rotating following the platen roller; a shaft holder configured to hold the supporting shaft; a removing and inserting section provided in the housing and configured to hold the shaft holder to be removable therefrom and insertable thereinto; a pawl section provided in the shaft holder, configured to resiliently hook to the removing and inserting section while allowing the shaft holder to be displaced in a removing and inserting direction thereof when the shaft holder is inserted into the removing and inserting section, and capable of releasing the hooking; a member holding section provided in the housing; and an urging member detachably attachable to the member holding section, nipped by the member holding section and the supporting shaft, and configured to apply pressing force on the platen roller to the pinch roller.

According to another aspect of the present invention, there is provided a portable printer including: a platen roller configured to rotate to convey a label sheet having a base sheet and labels stuck to the base sheet; a thermal print head opposed to the platen roller and configured to apply printing to the labels of the label sheet conveyed by the platen roller; a pinch roller opposed to the platen roller on a downstream side of the thermal print head in a sheet conveying direction and configured to nip the base sheet in cooperation with the platen roller and rotate following the platen roller via the base sheet to convey the base sheet; an urging member configured to apply pressing force on the platen roller to the pinch roller; and a holding section to which the pitch roller and the urging member are detachably attachable, the holding section being configured to enable replacement of the urging member when the pinch roller is removed.

DETAILED DESCRIPTION

An embodiment of the present invention is explained below with reference to the drawings.

Figure 1:
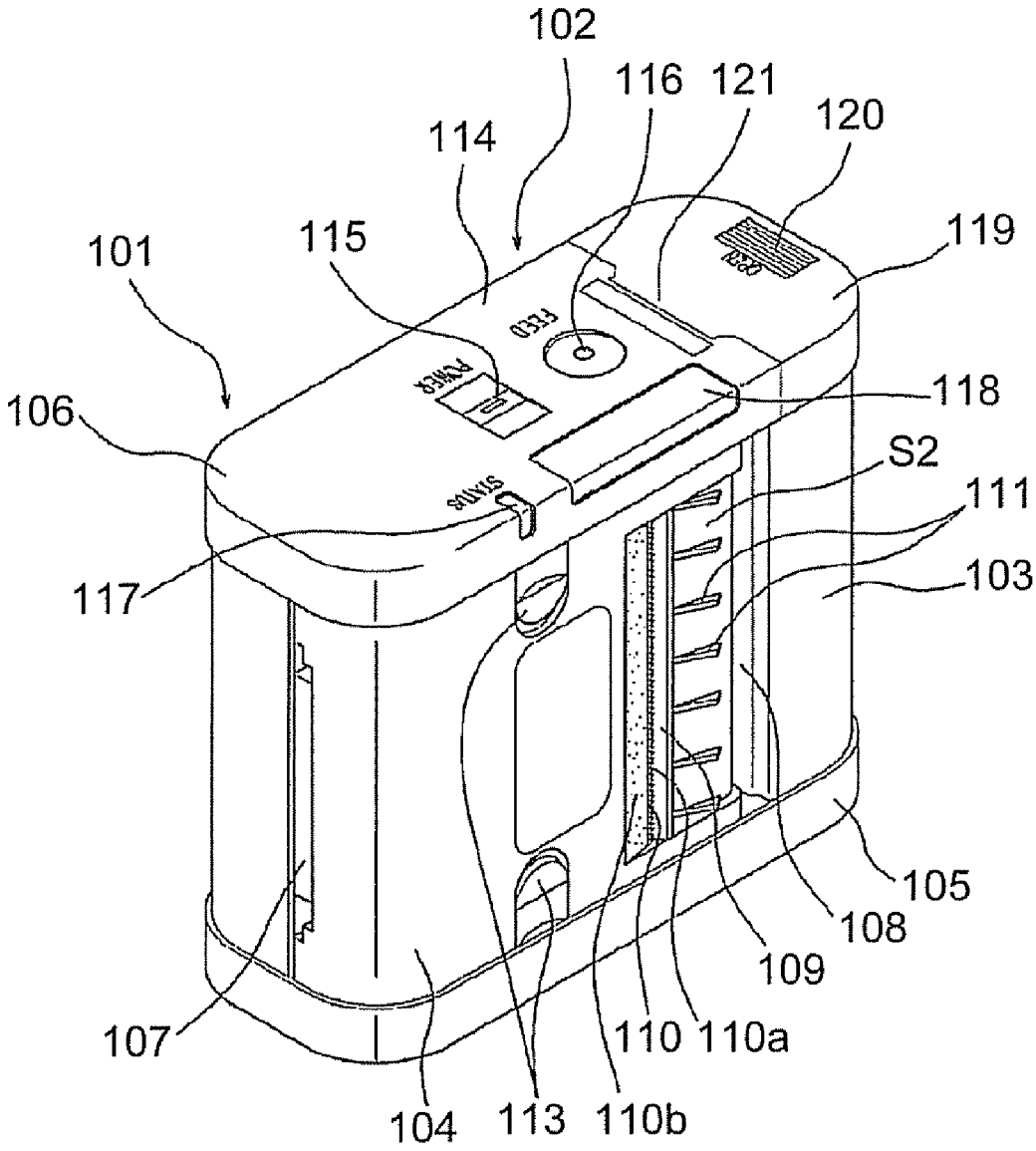
FIG. 1 is a perspective view of a portable printer according to an embodiment of the present invention.

FIG. 1 is a perspective view of a portable printer 101. The portable printer 101 according to this embodiment is driven by electric power supplied from a battery BT (see FIGS. 2 and 3). The portable printer 101 applies printing based on accumulated print data to roll paper P as a sheet. As the roll paper P, a label sheet 203 (see FIG. 2) wound in a roll shape, a slip sheet wound in a roll shape, liner-less label paper (not shown) wound in a roll shape, and the like can be used. The label sheet 203 has a base sheet 201 and plural labels 202 stuck to the base sheet 201. The portable printer 101 can implement, when the label sheet 203 is used as the roll paper P, both issuance forms, i.e., peeling and issuance for peeling off the labels 202 from the base sheet 201 and issuing the labels 202 and continuous issuance for not peeling off the labels 202 from the base sheet 201.

The portable printer 101 includes a housing 102. The housing 102 incorporates units of the portable printer 101 therein. The housing 102 includes a base housing 103 and an open cover 104 configured to be openable and closable with respect to the base housing 103. The base housing 103 includes a lower lid member 105 in a lower part thereof and has an upper lid member 106 in an upper part thereof. The open cover 104 is rotatably, openably, and closably attached on the front surface side of the base housing 103. Details of the base housing 103 and the open cover 104 are explained below.

First, the open cover 104 is explained in detail.

One end as a base side of the open cover 104 is rotatably supported by a hinge 107. The hinge 107 is provided on one side surface of the base housing 103. The other end as a distal end side of the open cover 104 is turned around to an area in a part on the front surface side of the base housing 103. The area in a part of the front surface side of the base housing 103 to which the distal end of the open cover 104 is turned around reaches an area close to the other side surface on the opposite side of the one side surface of the base housing 103. The distal end of the open cover 104 forms a base sheet discharge port 108 as a discharge port between the distal end and the base housing 103. When the peeling and issuance is carried out by using the label sheet 203 as the roll paper P, the base sheet 201 is discharged from the base sheet discharge port 108. The open cover 104 is openably and closably attached to the base housing 103. The open cover 104 forms a guide path 153 for the label sheet 203 between the open cover 104 and the base housing 103. In an open state, the open cover 104 exposes pinch rollers 160.

In the open cover 104, an issue port 109 as a discharge port is formed separately from the base sheet discharge port 108. The issue port 109 discharges printed roll paper P. Specifically, the issue port 109 issues, for example, the labels 202 on the label sheet 203 used as the roll paper P, a slip sheet, or liner-less label paper. The issue port 109 is an opening of a rectangular shape located near the distal end of the open cover 104. When viewed from the outside of the open cover 104, the issue port 109 is formed in a shape narrowed toward the depth side thereof. The bottom of the issue port 109 is opened in a slit shape. Therefore, two slopes S1 and S2 (for S1, see FIGS. 2 and 3) opposed to each other are formed on the base side and the distal end side of the open cover 104. A cutter 110 is attached to the slope S1 on the base side. Plural streaks of ribs 111 are projected and formed on the slope S2 on the distal end side.

The cutter 110 has a blade section 110*a* at the distal end thereof. The cutter 110 is a cutter of a tear cut type capable of tear-cutting the roll paper P with the blade section 110*a*. The cutter 110 has a cutter base 110*b* (see FIGS. 2 and 3) formed in a rectangular shape. The distal end of the cutter 110 is bent substantially at a right angle. The cutter 110 has the blade section 110*a* in this bent section. The cutter 110 is made of metal.

The ribs 111 are formed long toward a discharge direction of the base sheet 201. The ribs 111 smooth discharge operation for the base sheet 201.

The portable printer 101 further includes a pair of slide buttons 113 for opening and closing on both sides of the open cover 104. The open cover 104 can be opened and closed by sliding the pair of slide buttons 113 in directions in which the slide buttons 113 approach and separate from each other. Specifically, a not-shown engaging mechanism for releasably engaging the open cover 104 is provided between the base housing 103 and the open cover 104. The pair of slide buttons 113 release the engagement of the open cover 104 by the engaging mechanism by being slid in the direction in which the slide buttons 113 approach each other.

The base housing 103 is explained in detail below.

In the upper lid member 106 included in the base housing 103, an operation unit 114 is provided. The operation unit 114 includes a power switch 115, a paper feed button 116, an activation indicator 117, and a communication window 118. The activation indicator 117 and the communication window 118 are arranged across the upper surface side and the front surface side of the base housing 103. The portable printer 101 executes data transmission and reception by infrared communication from the communication window 118, receives, for example, print data, and accumulates the print data in a not-shown memory.

At an end of the upper lid member 106, a battery cover 119 is rotatably, openably, and closably provided. The battery cover 119 is arranged adjacent to the operation unit 114 at an end on the opposite side of the rotation supporting side of the open cover 104. A non-slip finger touching section 120 is formed in the battery cover 119. When an operator puts a finger on the finger touching section 120 and slides the battery cover 119 to the opposite side of the operation unit 114, the battery cover 119 is rotated and opened by a battery cover hinge 121 located on the side of the operation unit 114. The battery cover 119 enables attachment and detachment of the battery BT.

Figure 2:
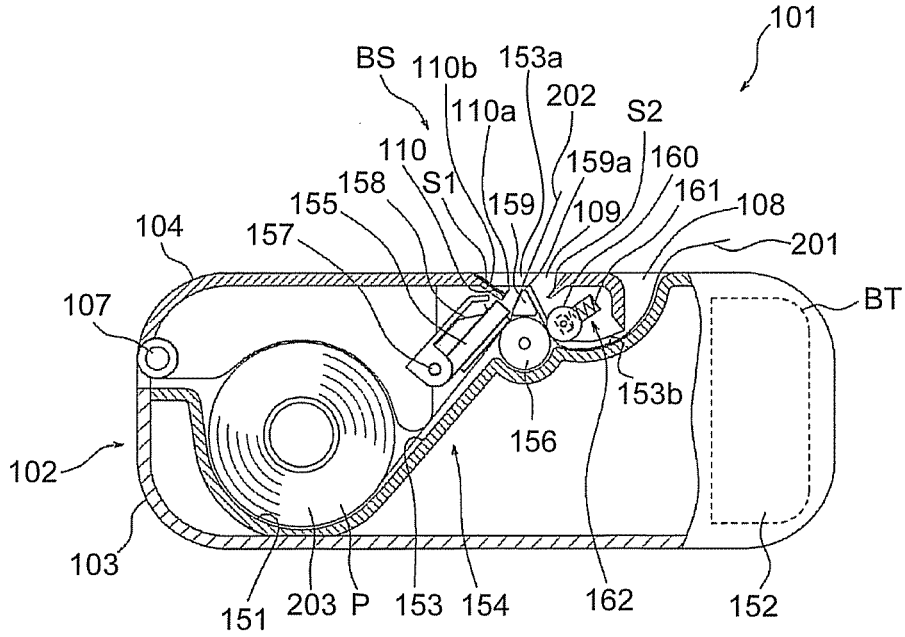
FIG. 2 is a longitudinal sectional side view of the portable printer.

FIG. 2 is a longitudinal sectional side view of the portable printer 101. The base housing 103 of the portable printer 101 includes a sheet storing section 151 and a battery housing section 152. The sheet storing section 151 stores the roll paper P such as the label sheet 203. The battery housing section 152 houses the battery BT. The base housing 103 forms the guide path 153 for the roll paper P stored in the sheet storing section 151 between the base housing 103 and the open cover 104. Both of the base sheet discharge port 108 and the issue port 109 communicate with the guide path 153. A printing and conveying unit 154 is provided along the guide path 153. The printing and conveying unit 154 conveys the roll paper P guided through the guide path 153 and performs printing.

The printing and conveying unit 154 includes a line-type thermal print head 155 and a platen roller 156. Specifically, the platen roller 156 is rotatably provided in the base housing 103. The platen roller 156 is driven to rotate by a not-shown motor to convey the roll paper P such as the label sheet 203. The platen roller 156 is located near the issue port 109 of the closed open cover 104. The thermal print head 155 is rotatably attached to the open cover 104. The thermal print head 155 is arranged to be opposed to the platen roller 156. The thermal print head 155 is rotatably attached to the open cover 104 by a head supporting shaft 157. The thermal print head 155 is urged by a leaf spring 158. A heat generating element row thereof comes into contact with the platen roller 156.

Further, a label peeling plate 159 located above the platen roller 156 is provided in the base housing 103. The label peeling plate 159 is a bar-like member. The label peeling plate 159 is arranged at a small distance from the platen roller 156. The label peeling plate 159 has a peeling section 159*a* formed at an acute angle. In this embodiment, the label peeling plate 159 is formed of a member not having conductivity such as resin. The peeling section 159*a* is located in a position facing the issue port 109. The guide path 153 not bent by the peeling section 159*a* directly communicates with the issue port 109. The guide path 153 bent by the peeling section 159*a* communicate with the base sheet discharge port 108. The guide path 153 directly communicating with the issue port 109 is an issue path 153*a*. The guide path 153 communicating with the base sheet discharge port 108 is a base sheet discharge path 153*b*. In this way, a guide path dividing structure BS for dividing the guide path 153 into the issue path 153*a* not bent by the label peeling plate 159 and the base sheet discharge path 153*b* bent by the label peeling plate 159 is formed. In other words, the label peeling plate 159 is arranged on the downstream side of the thermal head print head 155 in the sheet conveying direction and bends the guide path 153 to form the base sheet discharge path 153*b*.

The pinch rollers 160 are provided at the distal end of the open cover 104. The pinch rollers 160 come into contact with the platen roller 156 via the base sheet discharge path 153*b*. The pinch rollers 160 are pressed by coil springs 161 serving as urging sections. Pressing force against the platen roller 156 is applied to the pinch rollers 160 by the coil springs 161. The pinch rollers 160 and the coil springs 161 configure a pinch mechanism 162. In the pinch mechanism 162, further on the downstream side than the label peeling plate 159, the pinch rollers 160 come into contact with the platen roller 156 via the guide path 153 to be capable of rotating following the platen roller 156. In other words, the pinch rollers 160 are opposed to the platen roller 156 on the downstream side of the thermal print head 155 in the sheet conveying direction. The pinch rollers 160 nip the base sheet 201, from which the labels 202 are peeled off, in cooperation with the platen roller 156 and rotate following the platen roller 156 via the base sheet 201 to convey the base sheet 201.

Figure 3:
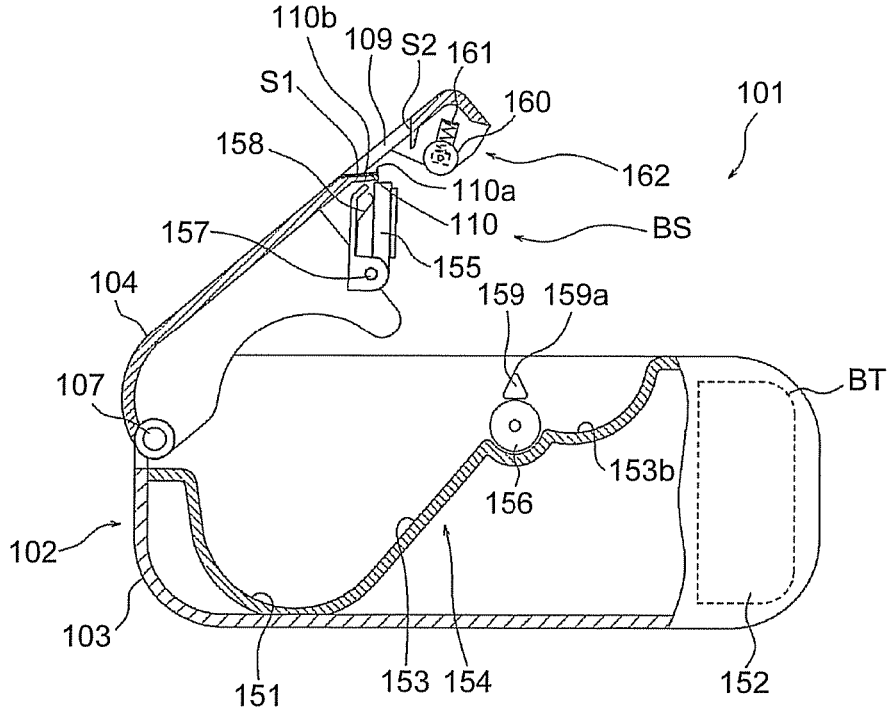
FIG. 3 is a longitudinal sectional side view of the portable printer with an open cover opened.

FIG. 3 is a longitudinal sectional side view of the portable printer with the open cover 104 opened. Referring to FIG. 3, it is well seen that the platen roller 156 and the label peeling plate 159 are provided on the side of the base housing 103 and the cutter 110, the thermal print head 155, and the pinch rollers 160 are provided on the side of the open cover 104.

As shown in FIG. 3, the open cover 104 opens to open the sheet storing section 151, the platen roller 156, the label peeling plate 159, and the entire guide path 153 including the base sheet discharge path 153*b* provided on the side of the base housing 103. The open cover 104 opens to also open the thermal print head 155 and the pinch mechanism 162 provided on the side of the open cover 104.

Figure 4:
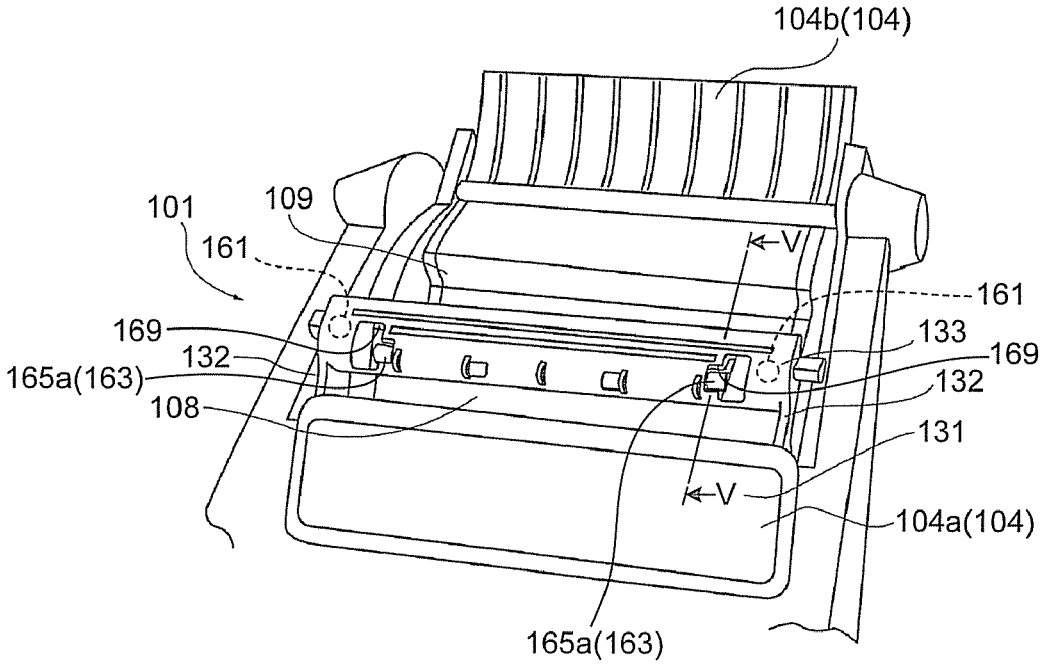
FIG. 4 is a perspective view of a section of an open cover divided into two in a portable printer according to another embodiment.

FIG. 4 is a perspective view of a section of the open cover 104 divided into two in the portable printer 101 according to another embodiment. In the embodiment shown in FIGS. 1 to 3, the sheet storing section 151, the platen roller 156, the label peeling plate 159, and the entire guide path 153 including the base sheet discharge path 153*b* are openably and closably covered by the single open cover 104 (see FIGS. 2 and 3). Therefore, in the open cover 104 according to the embodiment shown in FIGS. 1 to 3, a section for opening and closing the base sheet discharge path 153*b* and the other sections are integrally formed. On the other hand, in the open cover 104 according to the embodiment shown in FIG. 4, the section for opening and closing the base sheet discharge path 153*b* and the other sections are separately formed. Specifically, the open cover 104 according to the embodiment shown in FIG. 4 includes a first open cover 104*b* configured to cover an area extending from the sheet storing section 151 to the section of the issue path 153*a* communicating with the issue port 109 and a second open cover 104*a* provided separately from the first open cover 104*b* and configured to cover the base sheet discharge path 153*b* communicating with the base sheet discharge port 108. The issue port 109 is formed in a space between an end of the first open cover 104*b* and an end of the second open cover 104*a*.

The second open cover 104*a* includes a base 131, a pair of left and right arms 132, and a roller holding member 133. The base 131 is rotatably attached to the base housing 103. The roller holding member 133 is coupled to the base 131 by the pair of left and right arms 132. A rotation fulcrum (not shown) of the base 131 is arranged at an end on the opposite side of the hinge 107, which is a rotation fulcrum of the open cover 104, in the base housing 103. The second open cover 104*a* forms the base sheet discharge port 108 in a space between the base 131 and the roller holding member 133 coupled to each other by the arms 132. Therefore, whereas the base sheet discharge port 108 is formed between the distal end of the open cover 104 and the base housing 103 in the embodiment shown in FIGS. 1 to 3, the base sheet discharge port 108 is formed in the second open cover 104*a* in the embodiment shown in FIG. 4.

The roller holding member 133 detachably holds the pinch mechanism 162. The pinch mechanism 162 is explained below. Although the pinch mechanism 162 in the embodiment shown in FIG. 4 is explained, a basic structure of the pinch mechanism 162 for attaching and detaching the pinch rollers 160 and the coil springs 161 is common to the embodiment shown in FIGS. 1 to 3. Therefore, the following explanation is explanation of the pinch mechanism 162 that is applied in the same manner in the embodiment shown in FIGS. 1 to 3.

Figure 5:
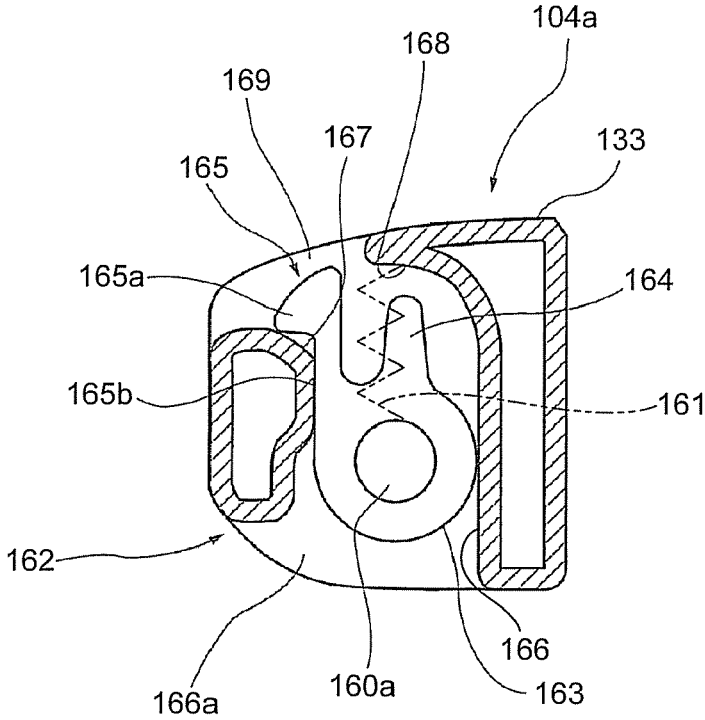
FIG. 5 is a longitudinal sectional side view of a roller holding member and a shaft holder along line V-V in FIG. 4.

FIG. 5 is a longitudinal sectional side view of the roller holding member 133 and shaft holders 163 along line V-V in FIG. 4. In FIG. 5, the coil springs 161 located on the front side on the paper surface with respect to the shaft holders 163 are indicated by an alternate long and two short dashes line. The roller holding member 133 and the shaft holders 163 configure an attaching and detaching structure for the pinch rollers 160. The pinch mechanism 162 includes a pair of shaft holders 163 configured to hold a supporting shaft 160*a* of the pinch rollers 160. The supporting shaft 160*a* is pressed into the shaft holders 163. The shaft holders 163 do not rotate with respect to the supporting shaft 160*a*. The shaft holders 163 are basically formed in a cylindrical shape. The shaft holders 163 include stoppers 164 and pawl sections 165. The stoppers 164 and the pawl sections 165 project in the same direction from the cylindrical outer circumferential surfaces of the shaft holders 163. The pawl sections 165 have pawls 165*a*. The pawls 165*a* extend beyond the diameter of the shaft holders 163 viewed in a direction orthogonal to an extending direction of the stoppers 164 and the pawl sections 165. The shaft holders 163 have flexible members 165*b*. The flexible members 165*b* couple the pawls 165*a* to main body sections of the shaft holders 163. The shaft holders 163 are, for example, resin mold products and have flexibility enough for bending the flexible members 165*b*.

The roller holding member 133 has removing and inserting sections 166 configured to hold the shaft holders 163 to be removable and insertable from a rear surface side thereof. The removing and inserting sections 166 are provided in the housing 102. Specifically, the removing and inserting sections 166 are provided in the second open cover 104*a* of the open cover 104. Removing and inserting holes 166*a* are formed in the removing and inserting sections 166. The shaft holders 163 are inserted into the removing and inserting holes 166*a*. A removing and inserting direction of the shaft holders 163 in the removing and inserting sections 166 is a direction in which the pinch rollers 160 can be displaced with respect to the platen roller 156. The diameter of the removing and inserting holes 166*a* is a dimension substantially the same as the diameter of the shaft holders 163. The shaft holders 163 are removable and insertable from and into the removing and inserting sections 166 by bending the pawl sections 165. In other words, the pawl sections 165 are provided in the shaft holders 163 and, when the shaft holders 163 are inserted into the removing and inserting sections 166, the pawl sections 165 resiliently hook to the removing and inserting sections 166 while allowing the shaft holders 163 to be displaced in a removing and inserting direction thereof and is capable of releasing the hooking. The pinch mechanism 162 (the pawl sections 165) is capable of releasing the hooking of the pawl sections 165 from the front surface side of the second open cover 104*a* in the open cover 104. In other words, the pawl sections 165 are capable of releasing the hooking to the removing and inserting sections 166 from the outer side of the housing 102.

The roller holding member 133 includes engaging sections 167. The pawls 165*a* of the shaft holders 163 inserted into the removing and inserting sections 166 hook to the engaging sections 167. The flexible members 165*b*, which are elastically deformed and bent when the shaft holders 163 are inserted into the removing and inserting sections 166, are released from the bending and restored to the initial state when the pawls 165*a* reach the engaging sections 167. In this state, the pawls 165*a* hook to the engaging sections 167 and the shaft holders 163 are prevented from coming off.

The roller holding member 133 includes contact sections 168. In a state in which the pawls 165*a* are hooked to the engaging sections 167, the contact sections 168 face the stoppers 164 at a small distance. The shaft holders 163 prevented from coming off the removing and inserting sections 166 are displaceable in the inside of the removing and inserting sections 166 by the distance between the stoppers 164 and the contact sections 168. An amount of the displacement specifies an amount of stroke of the pinch rollers 160 with respect to the platen roller 156.

Further, exposing holes 169 are formed in the roller holding member 133. The exposing holes 169 expose spaces in which the engaging sections 167 are located to the front surface side of the roller holding member 133. Therefore, the exposing holes 169 can expose the pawls 165*a* hooked to the engaging sections 167 to the front surface side of the roller holding member 133. Therefore, if the operator pushes the pawls 165*a* through operation from the front surface side of the roller holding member 133, the operator can release the hooking of the pawls 165*a* to the engaging sections 167 and remove the shaft holders 163 from the removing and inserting sections 166. The removal of the shaft holders 163 in this case is performed from the rear surface side of the roller holding member 133.

Figure 6:
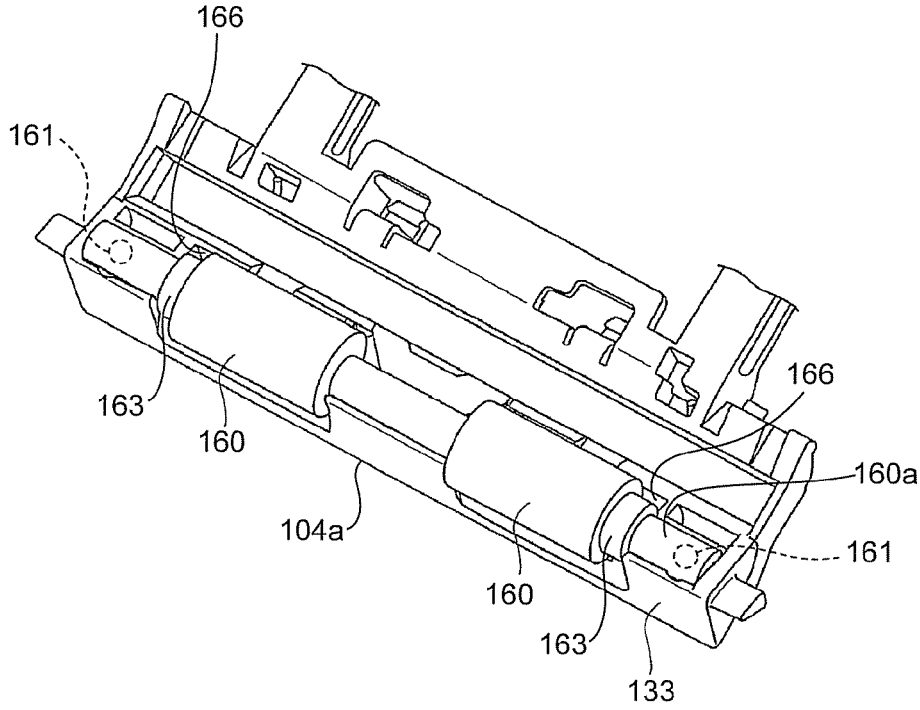
FIG. 6 is a perspective view of a second open cover viewed from a rear surface side thereof.

FIG. 6 is a perspective view of the second open cover 104*a* viewed from the rear surface side thereof. A pair of pinch rollers 160 are arranged in the roller holding member 133. The supporting shaft 160*a* is inserted into the pinch rollers 160. The pinch rollers 160 are rotatable with respect to the supporting shaft 160*a*. In other words, the supporting shaft 160*a* supports the pinch rollers 160 to be rotatable following the platen roller 156. Therefore, the shaft holders 163, into which the supporting shaft 160*a* is pressed, is inserted into the removing and inserting sections 166, whereby the pinch rollers 160 are rotatably attached to the roller holding member 133. The roller holding member 133 after the removal of the pinch rollers 160 is as shown in FIG. 7.

Figure 7:
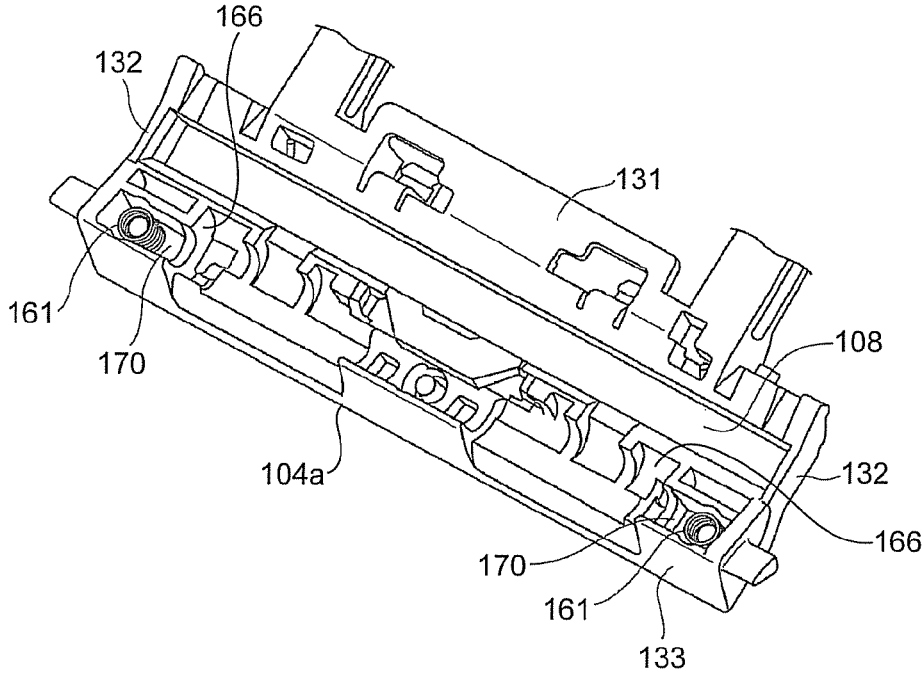
FIG. 7 is a perspective view of the second open cover, in which pinch rollers are removed from a roller holding member, viewed from a rear surface side thereof.

FIG. 7 is a perspective view of the second open cover 104*a*, in which the pinch rollers 160 are removed from the roller holding member 133, viewed from the rear surface side thereof. In the roller holding member 133, when the pinch rollers 160 are removed, a pair of coil springs 161 as urging members are exposed. The coil springs 161 are held by a pair of spring holding sections 170 that are member holding sections formed in the roller holding member 133. The spring holding sections 170 as the member holding sections are provided in the housing 102. Specifically, the spring holding sections 170 as the member holding sections are provided in the second open cover 104*a* in the open cover 104. The spring holding sections 170 are arranged further on the outer side than the removing and inserting sections 166 configured to removably and insertably hold the shaft holders 163. The coil springs 161 are detachably attachable to the spring holding sections 170 and nipped by the spring holding sections 170 and the supporting shaft 160*a* to apply pressing force on the platen roller 156 to the pinch rollers 160. When the shaft holders 163 are inserted into the removing and inserting sections 166, the spring holding sections 170 come into contact with the supporting shaft 160*a* pressed in the shaft holders 163. The pinch rollers 160 and the coil springs 161 are detachably attachable to the roller holding member 133 explained above. The roller holding member 133 functions as a holding member configured to enable replacement of the coil springs 161 when the pinch rollers 160 are removed.

As explained above, the shaft holders 163 are movable in a range in which the stoppers 164 come into contact with the contact sections 168 in a state in which the shaft holders 163 are inserted into the removing and inserting sections 166 and the pawls 165*a* are hooked to the engaging sections 167. When the pinch rollers 160 are mounted on the roller holding member 133, the coil springs 161 displace the shaft holders 163 until the pawls 165*a* come into contact with the engaging sections 167. The pinch rollers 160 are capable of stroking from a position where the stoppers 164 come into contact with the contact sections 168 to a position where the pawls 165*a* hook to the engaging sections 167. The stroke makes it possible to secure pressing force of the pinch rollers 160 against the platen roller 156.

The pressing force of the pinch rollers 160 against the platen roller 156 can be changed by simply changing a spring rate of the coil springs 161. In this case, in the portable printer 101 according to the embodiment (the embodiment shown in FIGS. 1 to 3 or the embodiment shown in FIGS. 4 to 7), the coil springs 161 are exposed when the pinch rollers 160 are removed. Therefore, it is extremely easy to perform replacement work for the coil springs 161.

In such a configuration, in each of the portable printers 101 shown in FIGS. 1 to 3 and FIGS. 4 to 7, the units are driven by power supply from the battery BT. The portable printer 101 executes data transmission and reception by infrared communication from the communication window 118, receives print data, and accumulates the print data in a not-shown memory. The portable printer 101 applies printing based on the accumulated print data to the roll paper P. Specifically, the portable printer 101 drives to rotate the platen roller 156 to convey the roll paper P stored in the sheet storing section 151. The portable printer 101 synchronizes the conveyance of the roll paper P and selective driving of not-shown heat generating elements of the thermal print head 155 to perform printing on the roll paper P based on the accumulated print data.

In the printing, in the case of the portable printer 101 shown in FIGS. 1 to 3, when the open cover 104 is closed with the label sheet 203 inserted through the issue port 109 in advance, continuous issuance operation can be performed. In the case of the portable printer 101 shown in FIGS. 4 to 7, when the label sheet 203 is pulled out and the first open cover 104*b* and the second open cover 104*a* are closed, the continuous issuance operation can be performed. Specifically, the portable printer 101 issues, from the issue port 109, the label sheet 203 on which the labels 202 after the printing by the thermal print head 155 are kept stuck to the base sheet 201. Similarly, when a slip sheet or a liner-less label is used as the roll paper P, the portable printer 101 closes the open cover 104 and performs printing with the roll paper P inserted through the issue port 109 in advance to issue the roll paper P after the printing by the thermal print head 155 from the issue port 109. When such an issue form is adopted, the roll paper P can be cut in a tear-cutting system by the blade 110*a* of the cutter 110.

When the label sheet 203 is used as the roll paper P, the portable printer 101 can perform peeling issuance operation. Specifically, in the case of the portable printer 101 shown in FIGS. 1 to 3, when the label sheet 203 is stored in the sheet storing section 151 and the open cover 104 is closed with the stored label sheet 203 pulled out in the direction of the base sheet discharge port 108, the peeling issuance operation can be performed. In the case of the portable printer 101 shown in FIGS. 4 to 7, when the stored label sheet 203 is pulled out and inserted through the base sheet discharge port 108 and the first open cover 104*b* and the second open cover 104*a* are closed, the peeling issuance operation can be performed. Specifically, the portable printer 101 performs printing operation to discharge the base sheet 201 of the label sheet 203 from the base sheet discharge port 108. The portable printer 101 peels off the labels 202, which are stuck to the base sheet 201, from the base sheet 201 with the label peeling plate 159 after the printing by the thermal print head 155 and issues the labels 202 from the issue port 109.

The portable printer 101 presses the pinch rollers 160 against the platen roller 156 via the guide path 153 bent by the label peeling plate 159 and performs peeling issuance of the printed labels 202. Because of such structure, when the label sheet 203 having relatively strong adhesiveness of the labels 202 on the base sheet 201 is used under a situation in which electric energy is limited such as driving by the battery BT, in some case, the peeling issuance cannot be normally performed. This is because, for the purpose of securing printing speed, usually, a spring rate of the coil springs 161 does not match such an exceptional label sheet 203 and pressing force of the pinch rollers 160 against the platen roller 156 is insufficient for such a label sheet 203.

When the label sheet 203 having relatively strong adhesiveness of the label 202 on the base sheet 201 is used, the coil springs 161 are replaced with the coil springs 161 having a high spring rate. As explained above, since the coil springs 161 are exposed when the pinch rollers 160 are removed, it is extremely easy to perform replacement work for the coil springs 161. When the operator removes the pinch rollers 160, the operator opens the roller holding member 133 and pushes the pawls 165*a* of the shaft holders 163 exposed in the exposing holes 169 formed on the front surface side of the roller holding member 133. Then, the pawls 165*a* drop from the engaging sections 167. Therefore, the operator only has to remove the shaft holders 163 from the rear surface side of the roller holding member 133. Consequently, the coil springs 161 are exposed on the rear surface side of the roller holding member 133. Therefore, the operator removes the coil springs 161 from the spring holding sections 170 and replaces the coil springs 161 with the coil springs 161 having an appropriate spring rate. If the operator inserts the shaft holders 163 into the removing and inserting sections 166 until the pawls 165*a* hook to the engaging sections 167, the replacement work for the coil springs 161 is completed. Therefore, the operator can extremely easily replace the coil springs 161.

Consequently, it is possible to prevent a fall in printing speed as long as the standard label sheet 203 is used. It is possible to prevent a peeling issuance failure of the labels 202 even when the exceptional label sheet 203 having relatively strong adhesiveness of the labels 202 on the base sheet 201 is used.

As explained above, according to this embodiment, it is possible to easily attach and detach the pinch rollers 160 by opening the open cover 104 capable of opening and closing the base sheet discharge path 153*b*. It is possible to easily replace the coil springs 161 by removing the pinch rollers 160. Therefore, it is possible to prevent a fall in printing speed as long as the standard label sheet 203 is used and it is possible to replace the coil springs 161 with the coil springs 161 having a high spring ratio and to prevent a peeling issuance failure of the labels 202 when the label sheet 203 having relatively strong adhesiveness of the labels 202 on the base sheet 201 is used.

In other words, the portable printer 101 is configured as explained below. The portable printer 101 includes the housing 102, the platen roller 156, the thermal print head 155, the label peeling plate 159, and the pinch mechanism 162. The housing 102 includes the base housing 103 and the open cover 104. The base housing 103 includes the sheet storing section 151 configured to store the roll paper P, which is an elongated sheet wound in a roll shape, and the battery housing section 152 configured to house the battery BT. The open cover 104 is openably and closably attached to cover the sheet storing section 151 in the base housing 103. The housing 102 forms the guide path 153 for the roll paper P stored in the sheet storing section 151 between the base housing 103 and the open cover 104. The platen roller 156 is arranged in the guide path 153 and rotates to apply conveying force to the roll paper P in the guide path 153. The thermal print head 155 comes into contact with the platen roller 156 via the guide path 153 and applies printing to the roll paper P guided and conveyed through the guide path 153. The label peeling plate 159 bends the guide path 153 on the downstream side of the thermal print head 155 to form the base sheet discharge path 153*b*. The pinch mechanism 162 brings the pinch rollers 160 into contact with the platen roller 156 via the guide path 153 further on the downstream side than the label peeling plate 159 to be capable of rotating following the platen roller 156. The pinch mechanism 162 includes the shaft holders 163, the removing and inserting sections 166, the pawl sections 165 formed in the shaft holders 163, and the coil springs 161 as the urging member. The shaft holders 163 hold the supporting shaft 160*a* of the pinch rollers 160. The removing and inserting sections 166 hold the shaft holders 163 to be removable and insertable from the rear surface side of the open cover 104 capable of opening and closing the base sheet discharge path 153*b* along the direction in which the pinch rollers 160 are displaceable with respect to the platen roller 156. When the shaft holders 163 are inserted into the removing and inserting sections 166, the pawl sections 165 resiliently hook to the open cover 104 while allowing the shaft holders 163 to be displaced in a removing and inserting direction thereof and is capable of releasing the hooking. The coil springs 161 are detachably attachable to the open cover 104 capable of opening and closing the base sheet discharge path 153*b*. The coil springs 161 are held with force accumulated by the pinch rollers 160 attached to the open cover 104 and apply pressing force on the platen roller 156 to the pinch rollers 160.

As still another embodiment, the spring holding sections 170 as the member holding sections and the removing and inserting sections 166 may be provided in the base housing 103 rather than the open cover 104. Specifically, the battery housing section 152 configured to house the battery BT, the sheet storing section 151 configured to store the label sheet 203, the spring holding sections 170 as the member holding sections, and the removing and inserting sections 166 may be provided in the base housing 103. The open cover 104 may form the guide path 153 for sheets between the open cover 104 and the base housing 103 and expose the pinch rollers 160 in an open state of the open cover 104. It goes without saying that, in this case, the portable printer 101 may also include the label peeling plate 159.

Further effects and modifications can be easily derived by those skilled in the art. Therefore, a wider aspect of the present invention is not limited by the specific details and the representative embodiment represented and described above. Therefore, various modifications are possible without departing from the spirit or the scope of the general concept of the invention defined by the appended claims and their equivalents.

What is claimed is:

1. A portable printer comprising:

a housing;

a platen roller rotatably provided in the housing and configured to rotate to convey a label sheet having a base sheet and labels stuck to the base sheet;

a thermal print head opposed to the platen roller and configured to apply printing to the labels of the label sheet conveyed by the platen roller;

a pinch roller opposed to the platen roller on a downstream side of the thermal print head in a sheet conveying direction and configured to nip the base sheet in cooperation with the platen roller and rotate following the platen roller via the base sheet to convey the base sheet;

a supporting shaft configured to support the pinch roller to be capable of rotating following the platen roller;

a shaft holder configured to hold the supporting shaft;

a removing and inserting section provided in the housing and configured to hold the shaft holder to be removable therefrom and insertable thereinto;

a pawl section provided in the shaft holder, configured to resiliently hook to the removing and inserting section while allowing the shaft holder to be displaced in a removing and inserting direction thereof when the shaft holder is inserted into the removing and inserting section, and capable of releasing the hooking;

a member holding section provided in the housing; and an urging member detachably attachable to the member holding section, nipped by the member holding section and the supporting shaft, and configured to apply pressing force on the platen roller to the pinch roller.

2. The printer according to claim 1, wherein the housing includes:

a base housing including a sheet storing section configured to store the label sheet; and an open cover including the member holding section and the removing and inserting section, openably and closably attached to the base housing, and configured to form a guide path for the label sheet between the open cover and the base housing.

3. The printer according to claim 1, wherein the housing includes:

a base housing including a sheet storing section configured to store the label sheet, the member holding section, and the removing and inserting section; and an open cover openably and closably attached to the base housing and configured to form a guide path for sheets between the open cover and the base housing.

4. The printer according to claim 3, further comprising a label peeling plate arranged on a downstream side of the thermal print head in the sheet conveying direction and configured to bend the guide path to form a base sheet discharge path.

5. The printer according to claim 3, wherein the base housing includes a battery housing section configured to house a battery, and the portable printer is driven by electric power supplied from the battery.

6. The printer according to claim 2, further comprising a label peeling plate arranged on a downstream side of the thermal print head in the sheet conveying direction and configured to bend the guide path to form a base sheet discharge path.

7. The printer according to claim 2, wherein the base housing includes a battery housing section configured to house a battery, and the portable printer is driven by electric power supplied from the battery.

8. The printer according to claim 2, wherein the pawl section is capable of releasing hooking to the removing and inserting section from an outer side of the housing.

9. The printer according to claim 6, wherein, in the open cover, a section for opening and closing the base sheet conveying path and other sections are separately formed.

10. The printer according to claim 6, wherein, in the open cover, a section for opening and closing the base sheet discharge path and other sections are integrally formed.

11. A portable printer comprising:

a platen roller configured to rotate to convey a label sheet having a base sheet and labels stuck to the base sheet;

a thermal print head opposed to the platen roller and configured to apply printing to the labels of the label sheet conveyed by the platen roller;

a pinch roller opposed to the platen roller on a downstream side of the thermal print head in a sheet conveying direction and configured to nip the base sheet in cooperation with the platen roller and rotate following the platen roller via the base sheet to convey the base sheet;

an urging member configured to apply pressing force on the platen roller to the pinch roller; and a holding section to which the pitch roller and the urging member are detachably attachable, the holding section being configured to enable replacement of the urging member when the pinch roller is removed.

* * * * *